US007194778B2

(12) United States Patent
Riach

(10) Patent No.: US 7,194,778 B2
(45) Date of Patent: Mar. 27, 2007

(54) BREAST COMFORT PADDING SYSTEM

(75) Inventor: Jeffrey M. Riach, Cockeysville, MD (US)

(73) Assignee: Oakworks, Inc., Shrewsbury, PA (US)

( * ) Notice: Subject to any disclaimer, the term of this patent is extended or adjusted under 35 U.S.C. 154(b) by 0 days.

(21) Appl. No.: 11/201,272

(22) Filed: Aug. 11, 2005

(65) Prior Publication Data

US 2006/0031993 A1 Feb. 16, 2006

Related U.S. Application Data

(60) Provisional application No. 60/600,391, filed on Aug. 11, 2004.

(51) Int. Cl.
*A47C 27/15* (2006.01)
*A47C 27/14* (2006.01)
*A61G 13/12* (2006.01)

(52) U.S. Cl. ..... 5/735; 5/727

(58) Field of Classification Search ..... 5/735, 5/930, 631, 727, 632, 630, 690; D24/183
See application file for complete search history.

(56) References Cited

U.S. PATENT DOCUMENTS 1,548,728 A 8/1925 Milam
3,626,526 A * 12/1971 Viel ..... 5/722
3,967,335 A 7/1976 Rhoads
4,021,872 A * 5/1977 Powell ..... 5/722
4,596,384 A 6/1986 Blosser
D318,923 S * 8/1991 Marsh ..... D24/183
5,095,569 A 3/1992 Glenn
5,400,449 A * 3/1995 Satto ..... 5/631
5,661,860 A 9/1997 Heitz
5,720,061 A 2/1998 Giori et al.
6,052,847 A 4/2000 Allyn et al.
6,081,948 A * 7/2000 Copeland ..... 5/632
6,185,768 B1 2/2001 Schlechter
6,934,988 B1 * 8/2005 Wetzler et al. ..... 5/621
2002/0184707 A1 12/2002 Stevens

* cited by examiner

*Primary Examiner*—Alexander Grosz
(74) *Attorney, Agent, or Firm*—Daniel S. Song; Nixon Peabody, LLP

(57) ABSTRACT

A breast comfort padding system is provided which includes a compressible body having an upper surface sized to support at least a chest area of a user thereon, at least a pair of recesses formed in the compressible body which are positioned with respect to each other on the compressible body to correspond to position of breasts, and compressible inserts received in the recesses, the compressible insert being more easily compressed than the compressible body.

25 Claims, 3 Drawing Sheets

FIG. 1
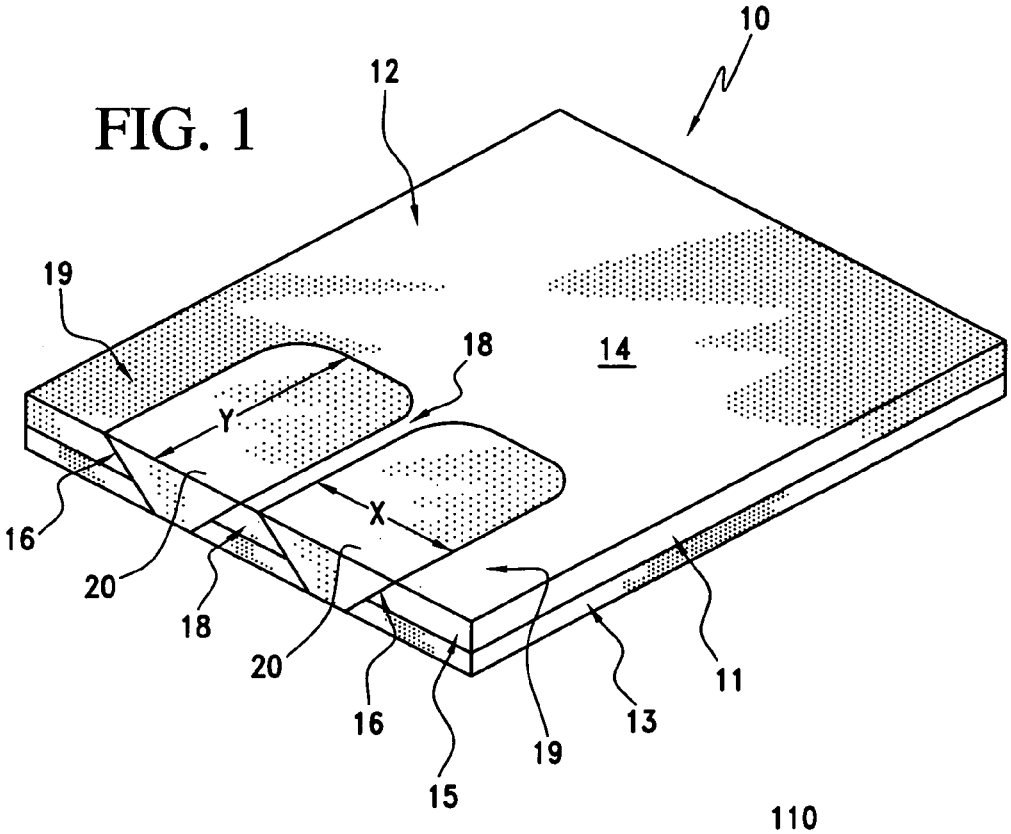
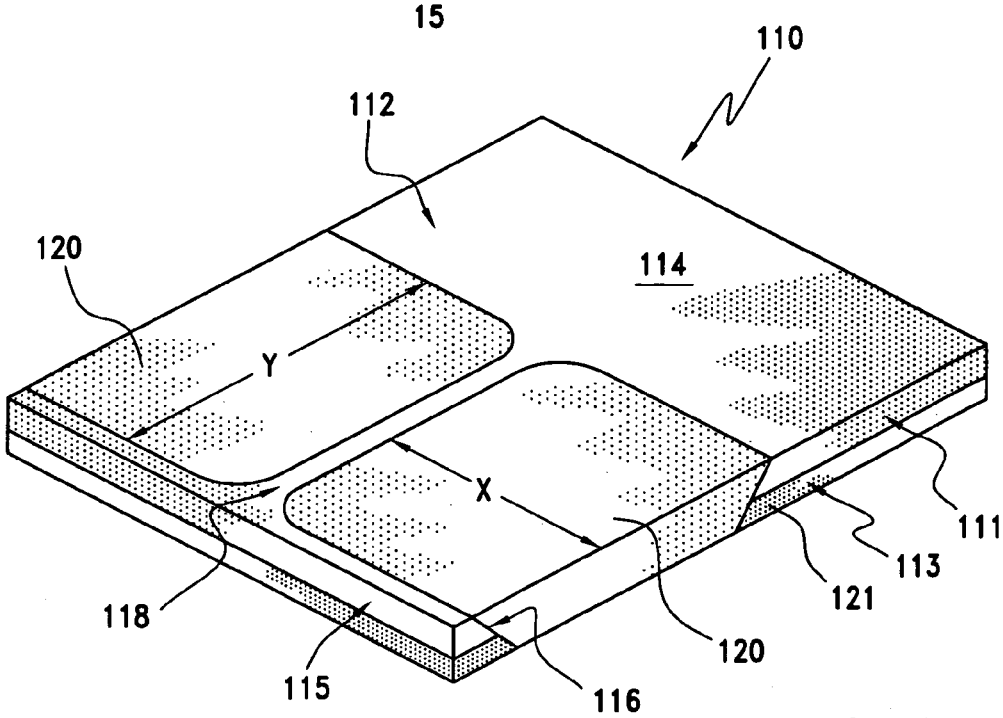
FIG. 4

BREAST COMFORT PADDING SYSTEM

This application claims priority to U.S. Provisional Application No. 60/600,391, filed Aug. 11, 2004, the contents of which are incorporated herein by reference.

BACKGROUND OF THE INVENTION

1. Field of the Invention

The present invention is directed to a padding system for allowing individuals with large breasts to lay prone more comfortably than with conventional padding systems. The present invention also allows therapists better access to a person's upper back while they are supine on the padding system.

2. Description of Related Art

Various cushion support and mattresses are known in the art for improving comfort to a woman laying prone by providing features on the cushion to receive the woman's breasts so that pressure on the breasts are reduced. For example, U.S. Pat. No. 1,548,728 to Milam discloses a mattress including a removable section of the mattress which is designed to be used when the bed is to be used by a woman having large breasts so that she may comfortably lie on her face. In this regard, recesses are formed upon the removal of the section to receive the breasts.

U.S. Pat. No. 4,596,384 to Blosser discloses a spinal adjustment table for use in osteopathy. The table includes separate support surfaces for the head, chest-abdomen and hip areas. The chest-abdomen support surface also includes breast receiving openings to facilitate altering the curvature of the dorsal spinal region without putting appreciable pressure on the breasts.

In another example, U.S. Pat. No. 5,720,061 to Giori et al. discloses a female anatomical mattress including a generally rectangular body supporting structure. The body supporting structure has an upper panel with a generally rectangular cavity that extends downwardly and toward the lower panel for receiving breasts of a female lying face down on the mattress. A generally rectangular head supporting structure is rounded and is sized for positioning within the cavity of the body supporting structure when not used to support a person's head. The mattress is disclosed as being foam filled or inflatable.

In another example, U.S. Pat. No. 6,185,768 to Schlechter discloses a cushion support to be placed on a bed or other horizontal support surface which allows a woman to lie or sleep in a face-down position without exerting pressure on the breasts. The cushion support includes an elongated block or wedge of foam material. The front section of which is horizontally oriented supports the upper rib cage and the sternum of the user, and a wedge-shaped lower section supports the torso of the user. Vertically oriented arcuate recesses are provided to accommodate the breasts. When lying in a face-down position, the breasts of the user depend downwardly into the recesses without contacting the underlying support surface or the cushion support.

Despite the known cushion and mattress designs, such devices are not commonly used. One reason is that they can be a source for embarrassment to the therapist and/or client due to the conspicuous shape of the prior art cushions and mattresses. For example, if the devices of the above noted prior art references are used in the intended manner, immediate attention is drawn to the client's breasts which can be embarrassing, especially if the client or the therapists is a male. Moreover, such known cushion and mattress designs only serve to increase comfort to the client when the client is laying prone on his/her stomach, and does not provide any benefit when the client is laying supine on his/her back. In this regard, such features for the breasts can actually decrease the client's comfort when laying supine because there is complete lack of support for the client in the breast receiving portions of the cushion or mattress.

Therefore, there exists an unfulfilled need for an improved cushion or mattress for improving comfort of the client when the client is laying prone on his/her stomach by minimizing pressure to the client's breasts. There also exists an unfulfilled need for such a cushion or mattress that is less conspicuous so as to not attract attention to the client's breasts. There further exists an unfulfilled need for such a cushion or mattress that is also comfortable when the client is laying supine on his/her back.

SUMMARY OF THE INVENTION

In view of the above, one object of the present invention is in providing an improved padding system for improving comfort of the client when the client is laying prone on his/her stomach by minimizing pressure to the client's breasts.

One advantage of one embodiment of the present invention is in providing such a padding system which is less conspicuous so as to not attract attention to the client's breasts.

Another advantage of another embodiment of the present invention is in providing such a padding system that provides progressive support of the client's breasts.

Yet another advantage of another embodiment of the present invention is in providing such a padding system that is also comfortable when the client is laying supine on his/her back.

Still another advantage of another embodiment of the present invention is in providing such a padding system that facilitates providing of massage or therapy services to the client.

In the above regard, the padding system of the present invention may be implemented as an integral part of a portable table such as a massage table with multi-piece top. The invention may also be implemented as a one piece top table, a separate padding system, or utilized as a chest support pad on a chair designed to support a person's chest.

The padding system in accordance with one implementation of the present invention includes two U shaped areas formed by inserts received in recesses positioned at each end thereof. Of course, the padding system may be provided on both ends, or just one, of the table. The recesses may be implemented with beveled surfaces around three sides. The U shaped inserts are made of a foam that is softer than foam used elsewhere. These two inserts are separated by a firmer mid-section, substantially trapezoidal or triangular in cross section, designed to support the sternum in prone positions, thereby supporting the patient in a coplanar fashion to the rest of the padding system. This trapezoidal section, in conjunction with the soft areas, allows a person's breasts to be comfortably supported by the soft foam without the normally high level of compression of the breasts which is typical of other padding systems.

The padding system in accordance with one embodiment of the present invention also allows a therapist to easily reach the client's upper back when the client is supine. This can be attained because the U shaped inserts are made of soft foam which can be easily compressed by the therapist. Alternatively, the U shaped inserts made of soft foam may be implemented to be easily removed and out of the way to allow the therapist inserts their hands under the client while the trapezoidal section and other firmer areas of foam keep the client's body supported. As can be appreciated, the padding system may be implemented so as to not draw visual attention to it so that any embarrassment for the client can be minimized.

In particular, in accordance with one embodiment of the present invention, a breast comfort padding system is provided which includes a compressible body having an upper surface sized to support at least a chest area of a user thereon, at least a pair of recesses formed in the compressible body which are positioned with respect to each other on the compressible body to correspond to position of breasts, and compressible inserts received in the recesses, a durometer value of the compressible insert being less than a durometer value of the compressible body so that the compressible insert is more easily compressed than the compressible body.

In accordance with one implementation, the recesses provided on the compressible body are substantially U shaped, extend to an edge surface of the compressible body, and have beveled side surfaces. The edge surface may be an end edge surface or a side edge surface. In yet another embodiment, the compressible inserts have a longitudinal dimension parallel to a height direction of the user which is larger than a transverse dimension perpendicular to the height direction of the user. In this regard, the longitudinal dimension of the compressible inserts may be at least 20% larger than the transverse dimension of the recesses, and in one embodiment, between 30% to 80% larger.

In yet another embodiment, the breast comfort padding system is further provided with a compressible mid-section that is positioned between the at least pair of recesses to support a sternum when the user is laying down in a prone position. In this regard, the compressible mid-section may have a substantially trapezoidal or triangular cross-sectional shape. Furthermore, the compressible inserts received in the recesses may be implemented to be removable from the recesses, or be affixed in the recess. Moreover, the breast comfort padding system may be multi-layered and include an upper section and a lower section, for example, where the upper surface is provided on the upper section. In this regard, the upper section preferably has a lower durometer value than the lower section.

Still another aspect of the present invention is a breast comfort padding system including a compressible body having an upper surface sized to support at least a chest area of a user thereon, and at least a pair of recesses formed in the compressible body which are positioned transversely with respect to each other on the compressible body to correspond to position of breasts, where the pair of recesses extend to an edge surface of the compressible body. The edge surface may be an end edge surface and/or a side edge surface.

Yet another aspect of the present invention is a breast comfort padding system including a compressible body having an upper surface sized to support at least a chest area of a user thereon, a recess formed in the compressible body, and a compressible insert received in the recess, the compressible insert having a longitudinal dimension parallel to a height direction of the user which is larger than a transverse dimension perpendicular to the height direction of the user, where a durometer value of the compressible insert is less than a durometer value of the compressible body so that said compressible insert is more easily compressed than the compressible body.

Yet another aspect of the present invention is in providing a massage table that incorporates a breast comfort padding system as described above.

These and other advantages and features of the present invention will become more apparent from the following detailed description of the preferred embodiments of the present invention when viewed in conjunction with the accompanying drawings.

BRIEF DESCRIPTION OF THE DRAWINGS

FIG. 1 is a top perspective view of the breast comfort padding system in accordance with one embodiment of the present invention with U shaped inserts.

FIG. 4 is a top perspective view of the breast comfort padding system in accordance with one embodiment of the present invention with U shaped inserts.

DETAILED DESCRIPTION OF THE PREFERRED EMBODIMENT

Figure 2:
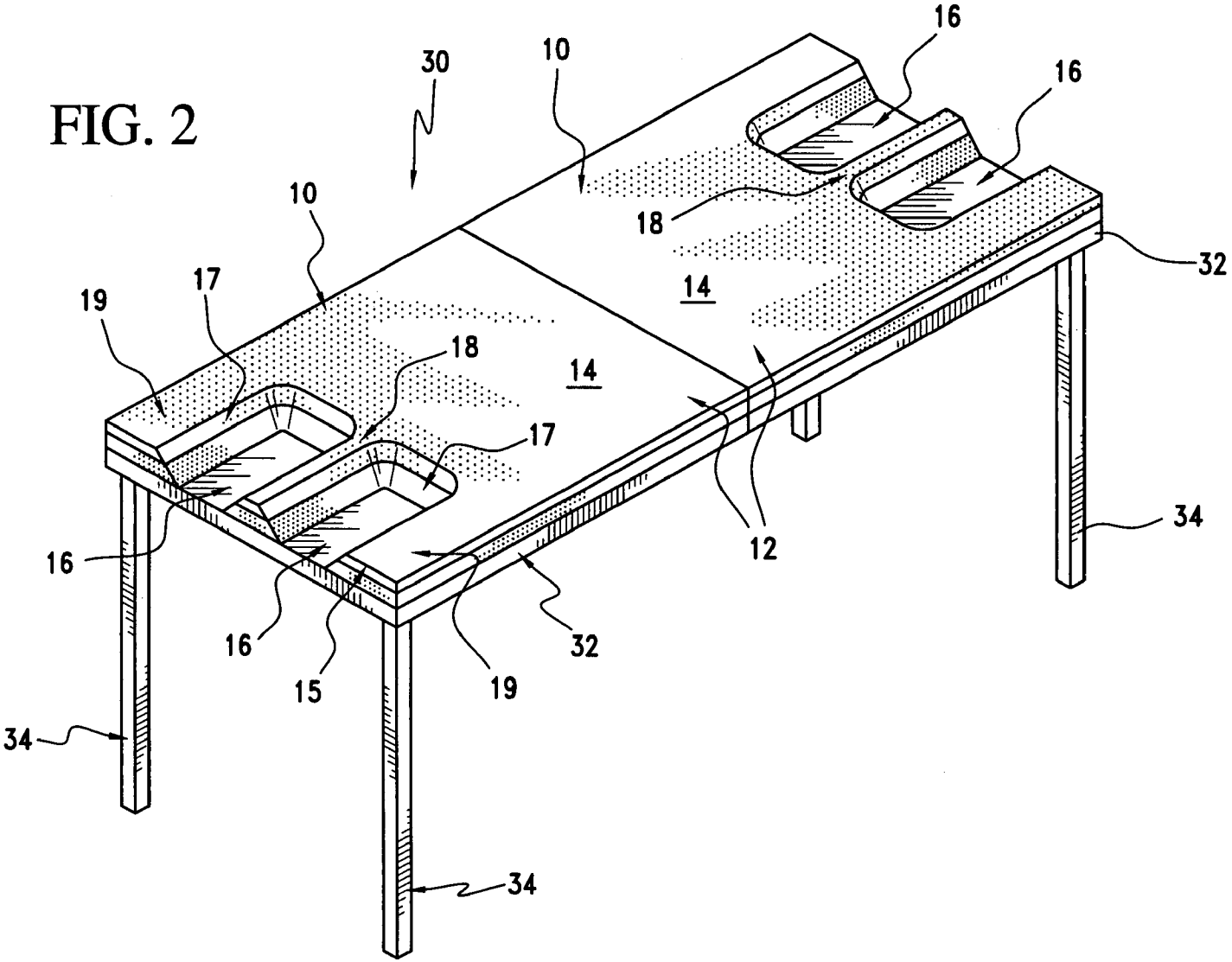
FIG. 2 is a top perspective view of the breast comfort padding system implemented in a massage table in accordance with one example embodiment of the present invention with the compressible inserts removed.

FIG. 1 shows a breast comfort padding system 10 in accordance with one example embodiment of the present invention that improves comfort of the client when the client is laying prone (on his/her stomach) by minimizing pressure to the client's breasts. As will be evident from the discussion below, the present invention may be implemented so that it is inconspicuous so as to not attract attention to the client's breasts. In addition, the breast comfort padding system 10 allows comfortable support of the client when the client is laying supine (on his/her back), and facilitates providing of massage or therapy services to the upper back of the client.

As shown in FIG. 1, the breast comfort padding system 10 includes a compressible body 12 that has an upper surface 14 which is sized to support at least a chest area of a client thereon. For example, the breast comfort padding system 10 of the present invention may be used in a massage or therapy table, a massage chair or other device. In this regard, the various geometric proportions of the breast comfort padding system 10, and in particular, the compressible body 12, as shown in FIG. 1, is merely provided as an example and the present invention is not limited thereto. Thus, the width, length, and thickness proportions may be altered while practicing the present invention.

The compressible body 12 may be made of any appropriate compressible material such as foam including foam made of polyurethane, polyethylene, memory foam, etc. that has a durometer value or firmness sufficient to allow comfortable support of a client's chest, and may be implemented with a plurality of layers. The compressible body 12 may be of any appropriate thickness, and may be implemented with a plurality of layers. For example, in the illustrated embodiment, the compressible body 12 includes an upper section 11 that is supported by a lower section 13 which is firmer than the upper section 11, i.e. has a higher durometer value than the upper section 11, to thereby provide progressively increasing support of the client laying on the breast comfort padding system 10.

The compressible body 12 in the illustrated embodiment includes a pair of recesses 16 formed in the compressible body 12. The pair of recesses 16 are positioned with respect to each other on the compressible body 12 to correspond to the transverse position of breasts with respect to the width of typically sized clients. The pair of recesses 16 extend through the upper section 11 and the lower section 13. As can be seen, the pair of compressible inserts 20 in the present illustrated embodiment have a substantially U shape as viewed from the top of the upper section 11.

The pair of recesses 16 of the illustrated embodiment of FIG. 1 also extend to the end edge surface 15 of the compressible body 12. In addition, as can be seen on end edge surface 15, the pair of recesses 16 are beveled in shape so as to have beveled side surfaces, this feature being described in fuller detail with respect to FIG. 2 hereinbelow. Of course, whereas the illustrated embodiment shows the recesses 16 with beveled side surfaces extending to the end edge surfaces 15 of the compressible body 12, other embodiments of the present invention may be implemented so that the recesses 16 are provided without such beveling and which are positioned toward the mid-portion of the compressible body 12 and/or do not extend to the end edge surface. In addition, in yet other embodiments, the recesses 16 may extend to the side edge surface of the compressible body instead of the end edge surface.

Referring again to FIG. 1, the breast comfort padding system 10 in accordance with the illustrated embodiment is further provided with a compressible mid-section 18 that is positioned between, and in the illustrated embodiment, is defined, by the pair of recesses 16. The compressible mid-section 18 is sized to support a sternum of the client when the client is laying down on the upper surface 14 of the compressible body 12 in a prone position. In this regard, because the pair of recesses of the illustrated embodiment are beveled in shape so as to have beveled side surfaces, the compressible mid-section 18 has a substantially trapezoidal or triangular cross-sectional shape as viewed along the end edge surface 15 of the compressible body 12. This trapezoidal mid-section 18 also provides comfortable support for the client's head when the client is laying on the breast comfort padding system 2 in a supine position.

Moreover, in the illustrated embodiment of FIG. 1, the compressible body 12 of the breast comfort padding system 10 is provided with arm support regions 19 that support the client's arms, whether the client is laying prone or supine on the compressible body 12. Of course, as can be appreciated, such arm support regions 19 are easily provided by sizing the width of the compressible body 12 so that compressible inserts discussed below do not span the entire width of the compressible body 12. In addition, in other embodiments, such arm support regions need not be provided at all.

The breast comfort padding system 10 of the present embodiment further includes optional compressible inserts 20 that are dimensioned to correspond to the shape of the pair of recesses 16 and are received therein. Thus, in the illustrated embodiment, the compressible inserts 20 have a U shape with tapered edges that corresponds to the pair of recesses 16 having the beveled side surfaces. These compressible inserts 20 are preferably sized large enough to support clients with a wide range of breast sizes, and to accommodate the client even if they are not perfectly centered on the table. When received in the pair of recesses 16, the compressible inserts 20 are preferably flush with the upper surface 14 as shown so as to provide a continuous surface so that attention is not drawn to the pair of recesses 16 and/or the compressible inserts 20. In this regard, the color of the upper section 11 and the compressible inserts 20 may be the same so that the compressible inserts 20 blend in with the compressible body 12 and is inconspicuous. Of course, in other embodiments, such compressible inserts 20 need not be provided in the breast comfort padding system, be implemented to be removable, or be coplanar with the upper surface 14 of the compressible body 12.

As can also be seen in FIG. 1, the compressible inserts 20 have a longitudinal dimension "Y" which is oriented parallel to the height of the client, and a transverse dimension "X" which is perpendicular to the height of the client when the breast comfort padding system 10 is used. In accordance with the illustrated embodiment of the breast comfort padding system 10 shown in FIG. 1, the longitudinal dimension "Y" is larger than a transverse dimension "X". In this regard, the longitudinal dimension Y of the compressible inserts 20 is preferably at least 20% larger than the transverse dimension X of the compressible inserts 20, and may be 30% to 80% larger. This feature allows for different relationships between the distance from the head to the breasts of the client laying on the breast comfort padding system 10, as well as accommodating breasts of different sizes, to allow comfortable support of clients of various heights and sizes. In addition, this feature in which the longitudinal dimension is greater than the transverse dimension also facilitates access to more of the client's back when the client is in the supine position.

Moreover, in addition to the geometric shape described above, the compressible inserts 20 of the illustrated embodiment is implemented to be softer than the compressible body 12. In this regard, the compressible inserts 20 may also be made of any appropriate material such as foam, but has a durometer value that is less than that of the compressible body 12. In addition, the compressible inserts 20 may be implemented so that they are readily removable from the recesses 16 of the compressible body 12. Of course, alternatively, the compressible inserts 20 may be affixed in the recess so that it is not readily removable.

One significant advantage of the illustrated embodiment of the present invention is that because the recesses 16 are provided with beveled and have beveled side surfaces, and the compressible inserts 20 received therein are correspondingly shaped, the firmness of the support provided by the breast comfort padding system 10 to areas of the client's breasts increases toward the side periphery of the breasts. In particular, as can be appreciated by examination of FIG. 1, the amount of support provided by the firmer lower section 13 and the upper section 11 progressively increases toward the periphery of the recesses 16 by the virtue of the beveled side surfaces of the recesses 16. Stated in another manner, the thickness of the softer compressible inserts 20 decreases toward the periphery of the recesses 16 while the thicknesses of the firmer sections of the compressible body 12 increase toward the periphery of the recesses 16. Thus, the illustrated embodiment of the breast comfort padding system 10 provides firmer support toward the peripheral edges of the breasts that are less sensitive, while providing softer support for the center of the breasts. This greatly enhances the client's comfort by minimizing compression and pressure at the most sensitive areas of the client's breasts, and reduces the likelihood of pinking that may occur in other prior art cushions and tables if the breasts are not perfectly positioned in the openings for the breasts.

FIG. 2 is a top perspective view of the breast comfort padding system as discussed above with respect to FIG. 1 which is implemented in a massage table 30 in accordance with one example embodiment of the present invention with the compressible inserts removed. The massage table 30 shown in FIG. 2 is of the portable, foldable type, having a two piece table top with two base frames 32 hingeably connected together, with a plurality of legs 34 connected to the base frames 32. The general structure of massage tables are well known in the art and the details thereof are omitted herein.

Again, it is noted that compressible inserts have been omitted in FIG. 2 to facilitate understanding and discussion of the recesses 16. Thus, just the firmer sections of the breast comfort padding system 10 is shown. In addition, it should be evident that the compressible bodies 12 are implemented with a laminated foam having different layers as described previously with respect to FIG. 1, these layers being implemented to have different thicknesses and/or firmnesses. However, the compressible bodies 12 may be implemented using a single layer or more than two layers, and with any appropriate material such as foam that is firmer than the compressible inserts.

As shown, the two breast comfort padding systems 10 are supported on each of the base frames 32 of the massage table 30. The two breast comfort padding systems 10 of the massage table 30 are substantially the same in the illustrated embodiment. Of course, in other embodiments, the massage table may be provided with only one breast comfort padding system. In addition, the present invention may also be implemented in non-folding, single section or multi-section tables by merely sizing the length of the compressible body 12 to correspond to the size of the table top. Further, the massage table 30 may included a separate head support (not shown) that extends past the end of the table for supporting the client's head thereon, such head support devices also being known in the art.

The breast comfort padding systems 10 are clearly shown in FIG. 2, each system 10 having a pair of recesses 16 which are positioned on the upper surface 14 of the compressible body 12 so as to correspond to transverse position of breasts with respect to the width of the typically sized client. In this regard, the pair of recesses 16 are transversely spaced so as to provide a mid-section 18, and the compressible bodies 12 are sized to provide arm support portions 19.

The recesses 16 shown in FIG. 2 are U shaped and have beveled side surfaces 17 which receive correspondingly shaped compressible inserts shown in FIG. 1 to thereby provide progressive firmness support to the breasts in the manner previously described. Of course, whereas in the illustrated embodiment, the side surfaces of the recesses 16 are beveled, other embodiments of the present invention may be implemented without a bevel so that the side surfaces of the recesses (and correspondingly, the compressible inserts received therein) are substantially perpendicular to the upper surface 14 of the compressible body 12. Moreover, in yet other embodiments, the beveled side surfaces may be implemented with a curve so that the recesses are radiused. However, by providing straight beveled side surfaces, the advantage of providing progressive firmness and support described previously can be readily attained.

As can also be seen in FIG. 2, the recesses 16 extend to end edge surface 15 of the breast comfort padding systems 10, and correspondingly, the end edge of the table 30. This provides an especially advantageous feature in that it allows the therapist providing massage services to the client laying supine on the table 30 to more easily reach the client's upper back and render services thereon. More specifically, the therapist can reach under the client's shoulder and reach the client's upper back by compressing down on the compressible inserts 20 shown in FIG. 1 further into the recesses 16. Because the compressible inserts 20 have a lower durometer value as compared to the compressible body 12, the therapist can more easily compress the inserts to reach the client's upper back than would otherwise be possible if no such recesses 16 with compressible inserts 20 are provided. Thus, the described feature allows a therapist to slide their hands easily under a patient lying supine, thereby facilitating work on the patient's back. Of course, in implementations of the present invention where the compressible inserts 20 are removable, or even not provided, the therapists can insert his/her hands into the recesses to reach the client's upper back because the recesses extend to the end edge of the compressible body 12.

In addition, as discussed previously with respect to FIG. 1, the recesses 16 are sized to receive compressible inserts therein. Correspondingly, in the illustrated embodiment, the recesses 16 have a longitudinal dimension parallel to a height direction of the user which is larger than a transverse dimension perpendicular to the height direction of the user when the breast comfort padding system of the present invention is used. This elongate shape of the recesses 16 and the corresponding compressible inserts received therein allows the client's breasts to be at various distances from the end of a table 30, which allows accommodation of clients of different heights and facilitates the use of head supporting devices that extend from the end of the table.

It should be again noted that whereas the illustrated embodiment shows the recesses 16 extending to the end edge surfaces 15 of the compressible body 12, and correspondingly, to the end edge of the massage table 30, other embodiments of the present invention may be implemented so that the recesses 16 do not extend to the end edge surface, but instead, be provided toward the mid-portion of the compressible body 12, or extend to the side edge surface of the compressible body 12. This would allow the client's head to be supported on the compressible body 12 of the table 30 while the client's breasts are still supported by the softer compressible inserts. However, by having the recesses 16 extend to the end edge surface 15 as shown, the special advantage is provided in facilitating the therapist in accessing the client's upper back when the client is laying supine on the table 30 as discussed above.

Figure 3:
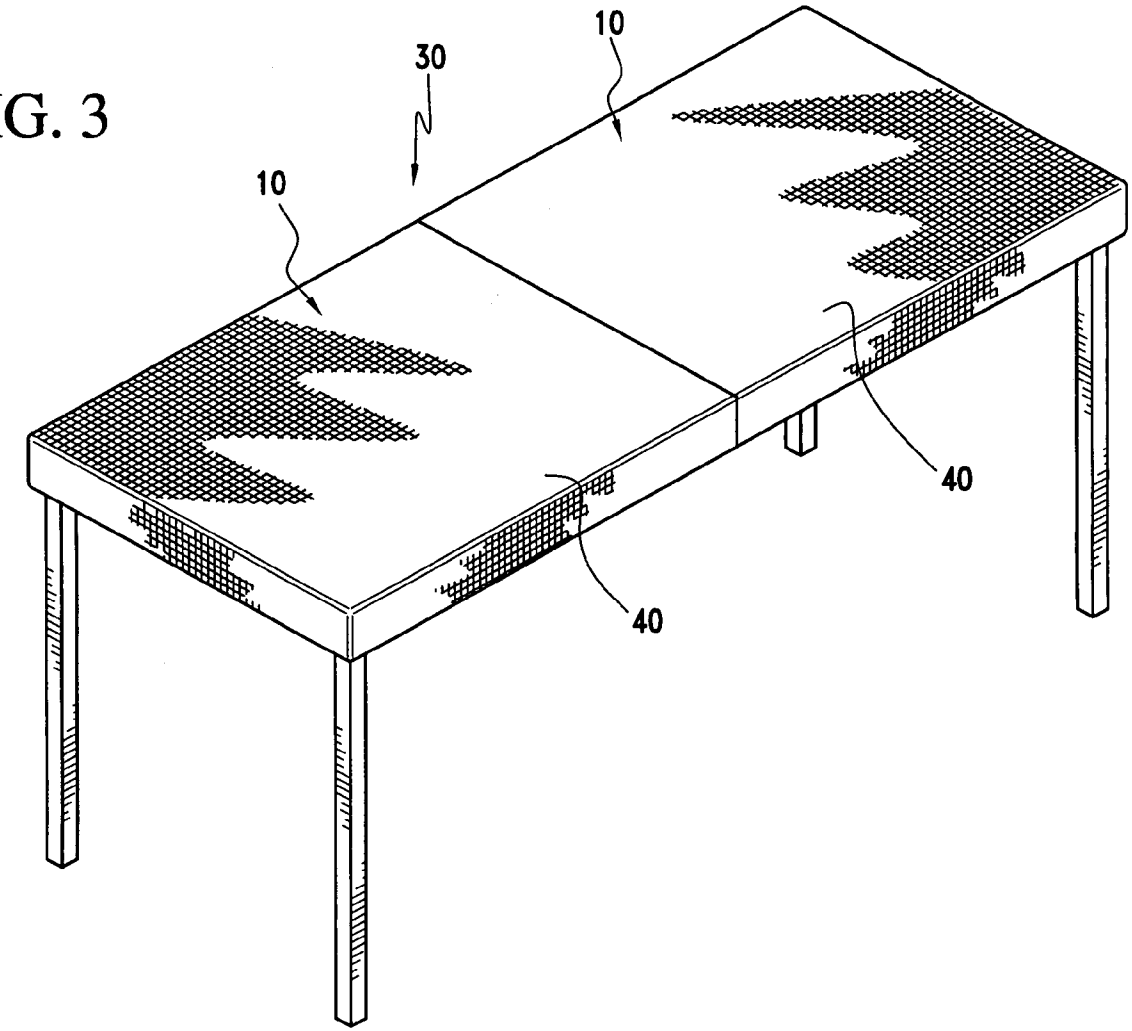
FIG. 3 is a top perspective view of the table of FIG. 2 with the breast comfort padding system being covered with a thin cover layer.

FIG. 3 shows the table 30 of FIG. 2 but the two breast comfort padding systems with the compressible inserts have been covered a layer of thin wrap foam and a protective cover 40. The protective cover 40 may be made of any appropriate material such as fabric, vinyl, or other covering. As can be appreciated, such covering of the breast comfort padding system of the present invention further makes the recesses and the compressible inserts even more inconspicuous, while these hidden features function to improve comfort of the client when the client is laying prone on his/her stomach by minimizing pressure to the client's breasts. Thus, the present invention can be implemented to minimize attracting attention to the client's breasts compared to prior art devices.

FIG. 4 is a top perspective view of the breast comfort padding system 110 in accordance with another example embodiment of the present invention with U shaped inserts. Like the embodiment discussed above relative to FIG. 1, the breast comfort padding system 110 includes a compressible body 112 that has an upper surface 114 and, in the illustrated embodiment, includes an upper section 111 that is supported by a lower section 113 which is firmer than the upper section 111.

The pair of recesses 116 are positioned with respect to each other on the compressible body 112 to correspond to the transverse position of breasts, and extend through the upper section 111 and the lower section 113. However, in contrast to the embodiment of FIG. 1, the pair of recesses 116 are formed in the compressible body 112 so as to extend to the side edge surfaces 121 of the compressible body 112. In addition, as can be seen on the side edge surface 121, the pair of recesses 116 are beveled in shape so as to have beveled side surfaces.

The breast comfort padding system 110 in accordance with illustrated embodiment is further provided with a compressible mid-section 118 that is positioned between, and in the illustrated embodiment, is defined, by a pair of recesses 116 (only one shown in FIG. 4). The compressible mid-section 118 is sized to support a sternum of the client when the client is laying down on the upper surface 114 of the compressible body 112 in a prone position.

The breast comfort padding system 110 also includes compressible inserts 120 that are implemented to be softer than the compressible body 112, and are dimensioned to correspond to the recesses 116 for receipt therein. In this regard, the compressible inserts 120 may be made of any appropriate material such as foam having a durometer value that is less than that of the compressible body 112, and be implemented to be removable or affixed in the compressible body 112. As can be seen, the pair of compressible inserts 120 in the present illustrated embodiment have a substantially U shape as viewed from the top of the compressible body 112.

Like the embodiment of FIG. 1, the compressible inserts 120 have a longitudinal dimension "Y" which is oriented parallel to the height of the client, and a transverse dimension "X" which is perpendicular to the height of the client when the breast comfort padding system 110 is used. In accordance with the illustrated embodiment of the breast comfort padding system 110 shown in FIG. 4, the longitudinal dimension "Y" is larger than the transverse dimension "X".

Because the recesses 116 are provided with beveled and have beveled side surfaces, and the compressible inserts 120 received therein are correspondingly shaped, the firmness of the support provided by the breast comfort padding system 110 to areas of the client's breasts increases toward the top and bottom periphery of the breasts while providing the softest support to the pressure sensitive areas toward the middle of the breasts.

This orientation of the recesses 116, and correspondingly, the compressible inserts 120 which extend to the side edge surfaces 121 of the compressible body 112, is not as user friendly to the therapists rendering services to the client laying supine on the breast comfort padding system 110 as compared to the embodiment shown and discussed above relative to FIG. 1. This is due to the fact that access to the upper back of the client is not as readily accessible at the end edge 115 of the breast comfort padding system 110. Of course, still other implementations of the present invention, the recesses and the correspondingly received compressible inserts may extend to both the end edge surface and the side edge surfaces of the breast comfort padding system 110.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

I claim:

1. A breast comfort padding system comprising:

a compressible body having an upper surface sized to support at least a chest area of a user thereon, said compressible body including an upper section and a lower section, said upper section having a lower durometer value than said lower section, and said upper surface being provided on said upper section;

at least a pair of recesses formed in said compressible body which are positioned transversely with respect to each other on said compressible body to correspond to position of breasts, said recesses extending through said upper section and into said lower section, and having beveled side surfaces; and compressible inserts received in said recesses;

wherein a durometer value of said compressible insert is less than a durometer value of said compressible body so that said compressible insert is more easily compressed than said compressible body.

2. The breast comfort padding system of claim 1, wherein said recesses are U shaped.

3. The breast comfort padding system of claim 2, wherein said recesses extend to an edge surface of said compressible body.

4. The breast comfort padding system of claim 3, wherein said edge surface is at least one of an end edge surface and a side edge surface.

5. The breast comfort padding system of claim 1, wherein said recesses extend to an edge surface of said compressible body.

6. The breast comfort padding system of claim 5, wherein said edge surface is at least one of an end edge surface and a side edge surface.

7. The breast comfort padding system of claim 1, wherein said compressible inserts have a longitudinal dimension parallel to a height direction of the user which is larger than a transverse dimension.

8. The breast comfort padding system of claim 7, wherein said longitudinal dimension of said compressible inserts are at least 20% larger than said transverse dimension of said compressible inserts.

9. The breast comfort padding system of claim 8, wherein said longitudinal dimension of said compressible inserts are approximately 30% to 80% larger than said transverse dimension of said compressible inserts.

10. The breast comfort padding system of claim 1, further comprising a compressible mid-section positioned between said at least pair of recesses to support a sternum when the user is laying down in a prone position.

11. The breast comfort padding system of claim 10, wherein said compressible mid-section has a substantially trapezoidal or triangular cross-sectional shape.

12. The breast comfort padding system of claim 1, wherein said compressible inserts are removable from said recesses.

13. The breast comfort padding system of claim 1, wherein said compressible inserts are affixed in said recesses.

14. A breast comfort padding system comprising:

a compressible body having an upper surface sized to support at least a chest area of a user thereon;

at least a pair of recesses formed in said compressible body which are positioned transversely with respect to each other on said compressible body to correspond to position of breasts, said recesses having beveled surfaces; and compressible inserts received in said recesses, said compressible inserts being affixed in said recesses;

wherein a durometer value of said compressible insert is less than a durometer value of said compressible body so that said compressible insert is more easily compressed than said compressible body, and said compressible inserts have a longitudinal dimension parallel to a height direction of the user which is larger than a transverse dimension perpendicular to the height direction of the user.

15. A breast comfort padding system comprising:

a compressible body having an upper surface sized to support at least a chest area of a user thereon;

at least a pair of U-shaped recesses formed in said compressible body which are positioned transversely with respect to each other on said compressible body to correspond to position of breasts; and compressible inserts received in said recesses, said compressible inserts having a longitudinal dimension parallel to a height direction of the user which is larger than a transverse dimension perpendicular to the height direction of the user, and said compressible inserts having a durometer value less than a durometer value of said compressible body so that said compressible insert is more easily compressed than said compressible body;

wherein said at least pair of recesses extend to side edge surfaces of said compressible body, and have a longitudinal dimension parallel to a height direction of the user which is larger than a transverse dimension perpendicular to the height direction of the user.

16. The breast comfort padding system of claim 15, further including a compressible mid-section positioned between said at least pair of recesses to support a sternum when the user is laying down in a prone position.

17. A breast comfort padding system comprising:

a compressible body having an upper surface sized to support at least a chest area of a user thereon, said compressible body including an upper section and a lower section, said upper section having a lower durometer value than said lower section, and said upper surface being provided on said upper section;

a recess formed in said compressible body, said recess extending through said upper section and into said lower section, and having beveled side surfaces; and a compressible insert received in said recess and having a longitudinal dimension parallel to a height direction of the user which is larger than a transverse dimension perpendicular to the height direction of the user;

wherein durometer value of said compressible insert is less than durometer value of said compressible body so that said compressible insert is more easily compressed than said compressible body.

18. The breast comfort padding system of claim 17, wherein said recess extends to an edge surface of said compressible body.

19. The breast comfort padding system of claim 17, wherein said edge surface is at least one of an end edge surface and a side edge surface.

20. The breast comfort padding system of claim 17, wherein said recess has a U shape.

21. A massage table comprising:

a plurality of legs; and a table top having a breast comfort padding system including:

a compressible body having an upper surface sized to support at least a chest area of a user thereon, said compressible body including an upper section and a lower section, said upper section having a lower durometer value than said lower section, and said upper surface being provided on said upper section;

at least a pair of recesses formed in said compressible body which are positioned with respect to each other on said compressible body to correspond to position of breast, said recesses extending through said upper section and into said lower section, and having beveled side surfaces; and compressible inserts received in said recesses;

wherein said compressible insert is more easily compressed than said compressible body.

22. The massage table of claim 21, wherein said recesses are U shaped, and extend to an end edge surface of said compressible body.

23. The massage table of claim 21, wherein said edge surface is a side edge surface of said compressible body.

24. The massage table of claim 21, wherein said compressible inserts have a longitudinal dimension parallel to a height direction of the user which is larger than a transverse dimension.

25. The massage table of claim 21, wherein said compressible inserts are removable from said recesses.

* * * * *